United States Patent [19]

Burnand et al.

[11] Patent Number: 5,037,451

[45] Date of Patent: Aug. 6, 1991

[54] MANUFACTURE OF ABRASIVE PRODUCTS

[76] Inventors: Richard P. Burnand, 39 Constantia Avenue Alan Manor; Raymond A. Chapman, 183 Columbine Avenue, Mondeor, both of Johannesburg, Transvaal; Trevor J. Martell, 8 Erica Place, Vale Road, Weltevreden Park, Transvaal; Stephen A. Parsons, 199 Downham Avenue, Mondeor, Johannesburg, Transvaal, all of South Africa

[21] Appl. No.: 400,457

[22] Filed: Aug. 30, 1989

[30] Foreign Application Priority Data

Aug. 31, 1988 [ZA] South Africa ..... 88/6474

[51] Int. Cl.[5] ..... B24D 3/00

[52] U.S. Cl. ..... 51/293; 51/303; 51/309

[58] Field of Search ..... 51/293, 303, 309

[56] References Cited

U.S. PATENT DOCUMENTS

| | | | |
|---|---|---|---|
| 3,743,489 | 7/1973 | Wentroy, Jr. et al. | 51/307 |
| 3,745,623 | 7/1973 | Wentroy, Jr. et al. | 29/95 B |
| 3,767,371 | 10/1973 | Wentroy, Jr. et al. | 51/293 |
| 4,063,909 | 12/1977 | Mitchell | 51/309 |
| 4,469,802 | 9/1984 | Endo | 501/96 |

FOREIGN PATENT DOCUMENTS 0278703 8/1988 European Pat. Off. .

*Primary Examiner*—William R. Dixon, Jr.
*Assistant Examiner*—Willie J. Thompson
*Attorney, Agent, or Firm*—Scully, Scott, Murphy & Presser

[57] ABSTRACT

The invention provides a method of making an abrasive product which comprises a layer of bonded ultra-hard abrasive particles bonded to a substrate. The abrasive product is typically a diamond or cubic boron nitride composite compact. The method includes the steps of:

(a) providing a substrate which has a surface to which the layer of bonded ultra-hard abrasive particles is to be bonded;

(b) providing a slurry of the components, in particulate form, necessary to make the layer of bonded ultra-hard abrasive particles in a liquid medium adapted to flow and to set to a green state under predetermined conditions;

(c) applying a layer of the slurry to the surface of the substrate;

(d) applying the predetermined conditions during step (c) or immediately thereafter to cause the liquid medium to set to a green state;

(e) contacting the green state layer with a complemental surface provided on a pressure pad;

(f) removing substantially all the liquid medium from the green state layer;

(g) placing the substrate/pressure pad combination in the reaction zone of a high temperature/high pressure apparatus; and (h) applying conditions of elevated temperature and pressure to the combination to convert the green state layer into a layer of bonded ultra-hard abrasive particles which is bonded to the substrate.

11 Claims, 1 Drawing Sheet

MANUFACTURE OF ABRASIVE PRODUCTS

BACKGROUND OF THE INVENTION

This invention relates to the manufacture of abrasive products.

Abrasive compacts are used extensively in cutting, milling, grinding, drilling and other abrasive operations. The abrasive compacts consist of a mass of diamond or cubic boron nitride particles bonded into a coherent, polycrystalline hard conglomerate. The abrasive particle content of abrasive compacts is high and there is an extensive amount of direct particle-to-particle bonding. Abrasive compacts are made under elevated temperature and pressure conditions at which the abrasive particle, be it diamond or cubic boron nitride, is crystallographically stable.

Abrasive compacts tend to be brittle and in use they are frequently supported by being bonded to a cemented carbide substrate. Such supported abrasive compacts are known in the art as composite abrasive compacts. The composite abrasive compact may be used as such in the working surface of an abrasive tool.

Examples of composite abrasive compacts can be found described in U.S. Pat. Nos. 3,745,623, 3,767,371, 3,743,489 and 4,063,909.

Composite abrasive compacts are generally produced by placing the components, in powdered form, necessary to form an abrasive compact on a cemented carbide substrate. This unbonded assembly is placed in a reaction capsule which is then placed in the reaction zone of a conventional high pressure/high temperature apparatus. The contents of the reaction capsule are subjected to conditions of elevated temperature and pressure at which the abrasive particles are crystallographically stable.

Other effective cubic boron nitride abrasive bodies which do not contain as high an abrasive particle content as abrasive compacts are also known and used in the art. Such abrasive bodies generally comprise a sintered body containing 40 to 60 volume percent of cubic boron nitride particles uniformly dispersed in a continuous ceramic bonding matrix. These abrasive bodies are also made under temperature and pressure conditions at which the cubic boron nitride is crystallographically stable. U.S. Pat. No. 4,469,802 describes such a body.

European Patent Publication No. 0278703 published 17 Aug. 1988 describes and claims a method of making an abrasive body which comprises a layer of bonded ultra-hard abrasive particles bonded to a substrate, including the steps of providing the substrate, depositing a layer of the components necessary to form the layer of bonded ultra-hard abrasive particles, in particulate form, in an organic binder on a surface of the substrate, and subjecting the substrate and layer to conditions of elevated temperature and pressure at which the ultra-hard abrasive particle is crystallographically stable. The layer of particulate components may be deposited on the surface of the substrate by suspending the particulate components in a liquid containing the organic binder dispersed or dissolved therein, depositing the liquid suspension on the surface and removing the liquid from the suspension. The layer of bonded ultra-hard abrasive particles will typically be a diamond or cubic boron nitride abrasive compact.

SUMMARY OF THE INVENTION

According to the present invention, there is provided a method of making an abrasive product which comprises a layer of bonded ultra-hard abrasive particles bonded to a substrate, including the steps of:

(a) providing a substrate which has a surface to which the layer of bonded ultra-hard abrasive particles is to be bonded;

(b) providing a slurry of the components, in particulate form, necessary to make the layer of bonded ultra-hard abrasive particles in a liquid medium adapted to flow and to set to a green state under predetermined conditions;

(c) applying a layer of the slurry to the surface of the substrate to which the layer of bonded ultra-hard abrasive particles is to be bonded;

(d) applying the predetermined conditions during step (c) or immediately thereafter to cause the liquid medium to set to a green state;

(e) contacting the green state layer with a surface provided on a pressure pad, which surface is complementary to the surface of the substrate with which the green state layer is in contact;

(f) removing substantially all the liquid medium from the green state layer;

(g) placing the substrate/pressure pad combination in the reaction zone of a high temperature/high pressure apparatus;

(h) applying conditions of elevated temperature and pressure to the combination to convert the green state layer into a layer of bonded ultra-hard abrasive particles which is bonded to the substrate.

DESCRIPTION OF THE DRAWING

The drawing illustrates a perspective view of components useful in the method of the invention.

DESCRIPTION OF EMBODIMENTS

Figure 1:
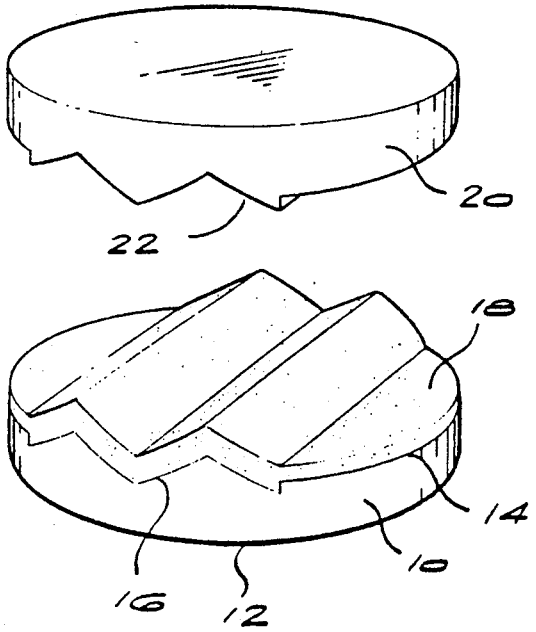

In step (c) the layer of the slurry is preferably applied to the substrate surface by a syringe or like means which enables a layer of uniform thickness to be applied to that surface. Further, this allows a layer of desired thickness to be applied accurately. Thereafter or at the same time conditions will be applied to cause the liquid medium to set to a green state, i.e. a state in which it has a coherency and will not flow. Preferably, the liquid medium is such that it will gel on application of heat. Thus, the substrate surface can be maintained at a suitable temperature such that, as the layer is applied to that surface, the liquid medium immediately gels producing a green state layer.

The liquid medium is preferably water containing a suitable binder dissolved or dispersed therein. Suitable binders are those which decompose or volatilise at a temperature of about 350° C. or lower and are capable of forming a gel. Examples of suitable binders are organic binders such as cellulose ethers or esters. An example of a particularly suitable binder is methyl cellulose. Methyl cellulose forms a suitable gel at a temperature of between 50° C. and 100° C.

The slurry may contain other ingredients such as plasticisers and surfactants and the like to assist in wetting the particulate components and improving the general rheological properties. An example of a suitable plasticiser is polyethylene glycol.

The pressure pad is applied to the green state layer so that a combination or assembly suitable for insertion into the reaction zone of a high temperature/high pressure apparatus is produced.

Preferably, a layer of a material capable of substantially preventing bonding of the green state layer to the pressure pad during the application of the high pressure/high temperature conditions is interposed between the pressure pad and the green state layer. An example of a suitable material is molybdenum. The pressure pad may be placed in contact with the green state layer either before or after removal of the liquid medium from the green state layer.

The removal of the liquid medium is preferably achieved by heating. When the liquid medium comprises water containing a suitable binder dissolved or dispersed therein this heating preferably takes place in two stages. In the first stage the layer is heated to a temperature above 100° C. to drive off the water. Thereafter, the layer is heated to such a temperature as to cause the binder to decompose or volatilise.

The conditions of elevated temperature and pressure which are used in step (h) are typically a pressure in the range 25 to 70 kilobars and a temperature in the range 1400° to 1600° C. Typically, these elevated conditions are maintained for a period of 10 to 30 minutes. The bonded abrasive product thus produced may be recovered from the reaction zone by methods known in the art.

The invention has particular application to the manufacture of composite abrasive compacts comprising a diamond or cubic boron nitride abrasive compact bonded to a cemented carbide substrate. The abrasive particles of the abrasive compact may be self-bonded or there may be present a second phase. It is preferred that the abrasive compact has a second phase. When the abrasive particles are diamond, the second phase will typically be, or contain, a catalyst or solvent for diamond manufacture such as cobalt. When the abrasive particles are cubic boron nitride, the second phase will typically contain or consist of aluminum, an aluminum alloy or ceramic compound.

The size of the particles of the components will vary according to the nature of the layer of bonded ultra-hard abrasive particles being produced. Generally, these particles will be fine, for example having a size of less than 150 microns.

With the method of the invention, it is possible to produce composite abrasive compacts and similar abrasive products wherein the interface between the layer of bonded ultra-hard abrasive particles and the substrate is irregular. Further, such abrasive products may be produced wherein not only is this interface irregular, but also the top surface of the layer of bonded ultra-hard abrasive particles is irregular. For example, the interface and/or the top surface of the layer of bonded ultra-hard abrasive particles may have a corrugated, scalloped or other similar shape.

The substrate will typically be made of cemented carbide such as cemented tungsten carbide, cemented tantalum carbide, cemented titanium carbide or mixture thereof.

An embodiment of the invention will now be described with reference to the accompanying drawing. Referring to this drawing, there is shown a cemented carbide substrate 10 of disc shape. The bottom surface 12 of the disc is flat while the top surface 14 has a plurality of corrugations 16 formed therein.

A slurry is made of a mass of diamond particles suspended in water which contains methyl cellulose dissolved therein. The viscosity of the slurry is such that it can flow. The slurry is placed in a syringe.

The cemented carbide substrate 10 is heated to a temperature of about 50° C. thereafter, a layer 18 of the slurry is deposited on the corrugated top surface 14. The layer is of uniform thickness. The temperature of the substrate is such that the dissolved methyl cellulose in the slurry gels progressively upwards from the substrate causing the layer to set to a green state which will not flow off the surface 14 or slide down the corrugations 16.

A pressure pad 20 is then placed on the green state layer 18. The pressure pad 20 has an under surface 2 which is corrugated and complementary to the corrugated top surface 14 of the substrate. The pressure pad is placed on the green state layer 18 so that an assembly is produced which is suitable for insertion in the reaction zone of a high temperature/high pressure apparatus. The pressure pad may be made of any suitable material such as cemented carbide, hexagonal boron nitride or the like. Preferably, a layer of a material such as molybdenum (not shown) is interposed between the corrugated under surface 2 and the layer 18 so that when the assembly is subjected to elevated temperature and pressure conditions there is no significant bonding between the layer 18 and the pressure pad.

The assembly is then heated, for example in an oven to a temperature above 100° C. to drive off the water from the green state layer 18. Thereafter, the assembly is heated to a temperature of approximately 350° C. to cause the methyl cellulose to decompose.

The assembly is placed in the reaction zone of a high temperature/high pressure apparatus. The contents of the reaction zone are subjected to a temperature of 1500° C. and a pressure of 55 kilobars and these conditions are maintained for a period of 10 minutes. The assembly is then removed from the reaction zone. The pressure pad 22 may be removed from the assembly by methods known in the art leaving a cemented carbide substrate 10 to which is bonded a diamond abrasive compact layer 18. This composite abrasive compact may be severed along planes perpendicular to the end surfaces 12, 14 to produce commercially useful tool inserts of a variety of shapes. One particularly useful shape is a "roof-top" shape produced by severing the product along planes perpendicular to the end surfaces 12, 14 and at adjacent depressions in the corrugated surface.

We claim:

1. A method of making an abrasive product which comprises a layer of bonded ultra-hard abrasive particles bonded to a substrate, includes the steps of:

(a) providing a substrate consisting essentially of cemented tungsten carbide, cemented tantalum carbide, cemented titanium carbide or mixtures thereof which has a surface to which the layer of bonded ultra-hard abrasive particles is to be bonded;

(b) providing a slurry comprised of diamond or cubic boron nitride particles, organic binder and water in particulate form, necessary to make the layer of bonded ultra-hard abrasive particles in a liquid medium adapted to flow and subsequently gel upon application in layer form to a suitable heated substrate and set to a green state under heat and pressure;

(c) applying a layer of slurry in a uniform thickness to the surface of the substrate to which the layer of bonded ultra-hard abrasive particles is to be bonded;

(d) applying the heat and pressure during step (c) or immediately thereafter to said substrate which is suitably heated to cause the liquid medium to gel and to set to a green state;

(e) contacting the green state layer with a surface provided on a pressure pad, which surface is complementary to the surface of the substrate with which the green state layer is in contact and having interposed therebetween a layer of material which substantially prevents bonding of the green state layer to the pressure pad;

(f) removing substantially all the liquid medium from the green state layer;

(g) placing the substrate/pressure pad combination in the reaction zone of a high temperature/high pressure apparatus;

(h) applying conditions of elevated temperature and pressure to the combination to convert the green state layer into a layer of bonded ultra-hard abrasive particles which is bonded to the substrate.

2. A method according to claim 1 wherein the liquid medium is water containing a suitable binder dissolved or dispersed therein.

3. A method according to claim 2 wherein the binder is capable of decomposing or volatilising at a temperature of about 350° C. or lower and of forming a gel in water.

4. A method according to claim 3 wherein the binder is an organic binder selected from cellulose ethers and esters.

5. A method according to claim 4 wherein the binder is methyl cellulose.

6. A method according to claim 5 wherein the interposed material of step 1(*e*) is molybdenum.

7. A method according to claim 1 wherein the liquid medium is removed in step (f) by heating.

8. A method according to claim 1 wherein the surface of the substrate to which the slurry is applied has a corrugated, scalloped or other similar shape.

9. A method according to claim 1 wherein the conditions of elevated temperature and pressure which are used in step (h) are a pressure in the range 25 to 70 kilobars and the temperature in the range of 1400° to 1600° C.

10. A method of making an abrasive product while preventing a slurry of particles from bonding to a pressure pad which comprises:

(a) providing a substrate which has a surface to which the layer of bonded ultra-hard abrasive particles is to be bonded (b) providing a slurry of components in particulate form in a liquid medium adapted to flow and set to a green state upon application of heat (c) applying a layer of material to a pressure pad which prevents bonding of the slurry to the pressure pad (d) applying a uniform layer of slurry to the substrate to which the slurry shall be bonded;

(e) applying heat and pressure to cause the liquid medium to gel and slurry to set to a green state.

11. The method of claim 10 where said material of step 14(*c*) is molybdenum.

* * * * *